US007786884B1

(12) United States Patent
McRoskey

(10) Patent No.: US 7,786,884 B1
(45) Date of Patent: Aug. 31, 2010

(54) ALARM EQUIPPED DOOR SAFETY DEVICE

(76) Inventor: John W. McRoskey, 1808 Aston Ave., Suite 180, Carlsbad, CA (US) 92008

( * ) Notice: Subject to any disclaimer, the term of this patent is extended or adjusted under 35 U.S.C. 154(b) by 0 days.

(21) Appl. No.: 12/471,143

(22) Filed: May 22, 2009

(51) Int. Cl.
*G08B 21/00* (2006.01)

(52) U.S. Cl. ..... 340/686.1; 49/383; 340/691.1; 340/693.9

(58) Field of Classification Search ..... 340/686.1, 340/691.1, 693.5, 692, 693.9, 545.1
See application file for complete search history.

(56) References Cited

U.S. PATENT DOCUMENTS 4,261,140 A * 4/1981 McLean ..... 49/383
2002/0157319 A1* 10/2002 Haq ..... 49/383

* cited by examiner

*Primary Examiner*—Daniel Wu
*Assistant Examiner*—Frederick Ott
(74) *Attorney, Agent, or Firm*—Donn K. Harms

(57) ABSTRACT

An alarm equipped door safety device for engagement at the hinge-side of a door's interface with a door jamb. The device is formed of an elastic body which prevents closure of the door to provide protection against crushing of a finger or object between the door and jamb. To provide warning and protect the door, the door jamb, and the hinges from stress damage, a body-compression activated switch generates a sonic alarm when closure of the door is attempted with the device engaged.

20 Claims, 5 Drawing Sheets

ALARM EQUIPPED DOOR SAFETY DEVICE

BACKGROUND OF THE INVENTION

1. Field of the Invention

The disclosed device is a safety device which includes an audible warning signal while concurrently preventing the crushing of a finger between the door and the door jamb. The safety device is adapted for engagement to the hinge side of a door rotationally engaged within a door jamb. With the disclosed device engaged at the hinge side of a door between the door edge and the door jamb, that door is prevented from closing past a distance which would allow injuries to a finger positioned between the door and the door jamb. An audible warning signal or alarm is activated when an attempt is made to close the door while the safety device is engaged. The warning signal gives notice that the closure of the door is blocked. This eliminates or substantially reduces the potential for damage to the door, jamb, or hinges from the application of excessive force by unknowing or forgetful persons (or children at play). Further, the device is formed of a material sufficiently compressible to help prevent its presence in-between the door and the jamb during an attempted closure, from causing structural damage to the hinges, the door jamb, and the door itself.

2. Prior Art

Conventionally, doors are commonly mounted in a rotational engagement using hinge pins secured to a door jamb wall. In this rotatable engagement the door is free to rotate about its hinges from an open position extending at an angle from the wall supporting a door jamb, to a closed position substantially flush with the wall and surrounded by the door jamb on four sides.

Because of the size and mass and mechanical advantage of most doors and the relatively small area between the side edges of the door and the surface of the surrounding door jamb, a great amount of pressure is imparted to anything unlucky enough to be positioned between the side edge of the door where it engages the hinges, and the surface of the jamb when the door closes.

With young children in the house, and some cases even adults, finger injuries from closing doors have become ever more common. Such injuries occur when the child or adult inexplicably places one or more fingers between the side edge of the door and the jamb surface supporting the hinges as the door is closed. When the door closes with a finger in this position, severe injury or amputation can occur.

A number of devices have been developed to block the closing of a door on fingers which are in a position to be crushed between the door and the door jamb. However, no device exists which concurrently also provides means to protect the door, the door jamb, and the door hinges from damage caused by the use of excessive force in an attempt to close a door by persons unaware that the door has been so blocked.

When a door is blocked from closing and an attempt is made to force it closed the forces developed are such that the door mounts can be damaged or the door itself pulled from its hinge mounts or otherwise damaged. This type of problem can occur either because of a lack of awareness or recollection that the door has been blocked, or when children are playing with a door which has the safety device engaged.

As such, there is a continuing unmet need for an improved safety device which will not only temporarily block the closing of the door, but also will sound an alarm should an attempt be made to close the door with the safety device engaged. Such a device should be easily engageable on the hinge side of the door in the space between the edge of the door and the door jamb, and should provide the user with an audible warning should closure be attempted. Such a warning provides notice to the individual attempting to close the door that it is blocked. Still further such a device should audibly alert parents and other adults when child-play threatens to harm a door system. Such a safety device should provide an audible alarm that may be heard from a distance, or while proximate to the door.

SUMMARY OF THE INVENTION

The device and method of employment herein disclosed and described achieves the above-mentioned goals through the provision of a door-engageable audible alarm.

The device features a substantially flexible body portion formed of sturdy elastic and slightly compressible material such as polyurethane.

The body portion may employ a plurality of ribs about the exterior surface of the body having gaps therebetween. These ribs being thinner than the width across the entire body, are more easily deformable and compressible if the door edge is forced toward the door jamb during an attempted closure thereby providing means to help prevent damage to the door surface, the jamb surface, and a disengagement of the hinges from the jamb should the door be slammed. The ribs may also improve cycle times in the manufacture of the product.

Engaged within a cavity in the body portion, is a means for audible alarm which currently is a buzzer. The buzzer is engaged to a power supply which is interrupted by a switch which must be closed to complete the circuit and sound the buzzer. A novel switch is provided which uses the body's contact with the side edge of the door and the surface of the door jamb for activation of the switch. As such, no moving parts or switches or other components project from the outside surface of the body portion of the device which might mar or dent the surface of the door or jamb on contact or be damaged in a slam of the door. Consequently the surface of the body is uninterrupted by hard projections thereby maintaining the above noted means for damage prevention to the door and jamb.

The switching means in the preferred mode requires no wires or solder points which can increase the likelihood of a malfunction from cold solder joints or wire damage. In the preferred mode, the device actually employs one of the alarm or buzzer contacts as the moveable switch component which completes the circuit to the battery providing energy for when the contact is depressed by a pressure plate element of the body communicating between it and the door edge or jamb.

As such, the device provides an exterior surface adapted to both prevent finger injuries upon attempted closure of the door and concurrently provides an audible warning signal to avoid damage to the door, jamb, and hinge when the safety device is engaged. When employed in an engaged position on a door which is subjected to a closing action, the device produces an audible warning to both the closing party to cease closing the door, and to a remote party (e.g., a parent), that someone is trying to close the door with the safety device engaged.

It is an object of this invention to provide an improved door closure alarm which prevents damage to the door and jamb.

It is an additional object of this invention to provide such a door closure alarm which employs an alarm component which does not require excess wires or solder joints.

A further object of this invention is the provision of such a door closure alarm which positions the switch against the door side edge or jamb thereby maintaining the smooth exterior surface of the door jamb and preventing damage to the door or door jamb.

These together with other objects and advantages which become subsequently apparent reside in the details of the construction and operation as more fully hereinafter described and claimed, reference being had to the accompanying drawings forming a part thereof, wherein like numerals refer to like parts throughout.

With respect to the above description, before explaining at least one preferred embodiment of the herein disclosed invention in detail, it is to be understood that the invention is not limited in its application to the details of construction and to the arrangement of the components in the following description or illustrated in the drawings. The invention herein described is capable of other embodiments and of being practiced and carried out in various ways which will be obvious to those skilled in the art. Also, it is to be understood that the phraseology and terminology employed herein are for the purpose of description and should not be regarded as limiting.

As such, those skilled in the art will appreciate that the conception upon which this disclosure is based may readily be utilized as a basis for designing of other structures, methods and systems for carrying out the several purposes of the present disclosed device. It is important, therefore, that the claims be regarded as including such equivalent construction and methodology insofar as they do not depart from the spirit and scope of the present invention.

BRIEF DESCRIPTION OF DRAWING FIGURES

The accompanying drawings, which are incorporated in and form a part of this specification, illustrate preferred embodiments of the invention and together with the description, serve to explain the principles of this invention.

DETAILED DESCRIPTION OF THE PREFERRED EMBODIMENTS OF THE INVENTION

Figure 1:
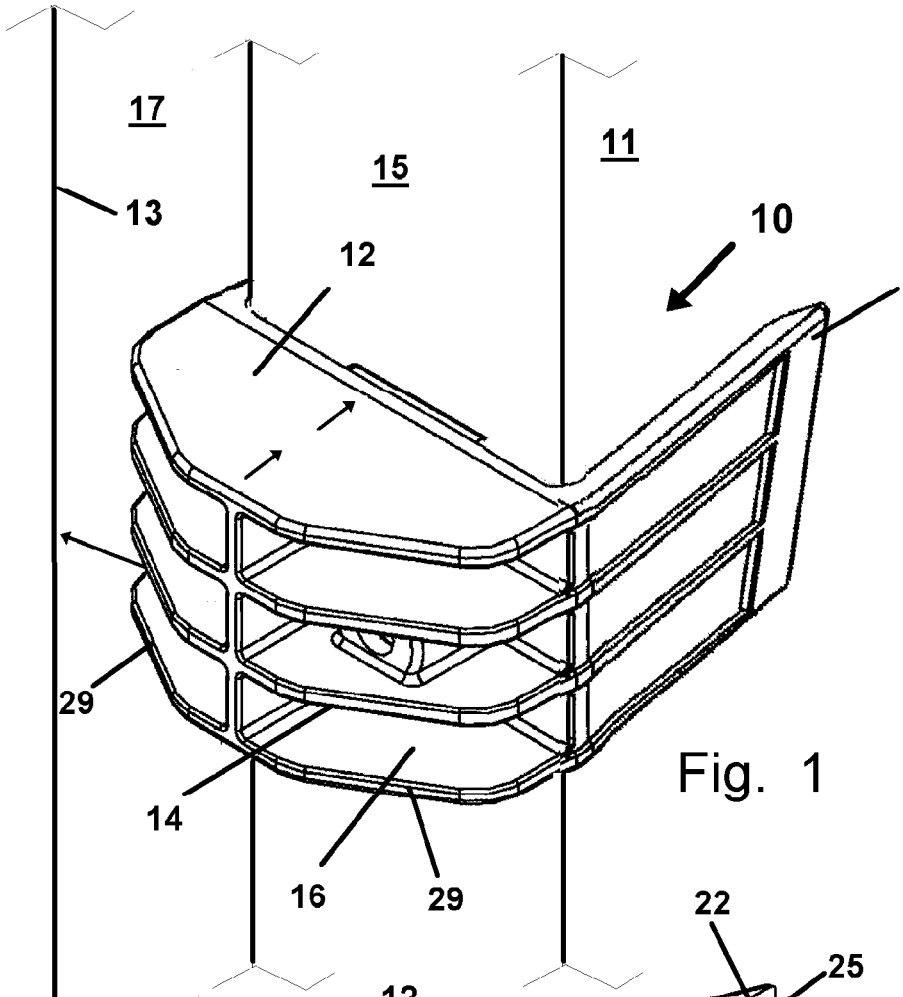
FIG. 1 depicts a perspective view of a preferred mode of the device showing the body portion engaged between the door and jamb and held to the hinge side of the door in a biased frictional engagement.

Referring now to the drawings and FIGS. 1-9, wherein similar parts of the invention are identified by like reference numerals in one or more of the different drawings, there are illustrated various preferred embodiments of the device 10. It is to be understood that other embodiments may be utilized and structural changes may be made without departing from the scope of the present invention and any and all changes or adaptations which may be made by those skilled in the art, are considered to be within the scope of the claimed device and method.

As shown in FIG. 1 the device 10 depicted in an engaged position on the hinged edge of a door 11, in the space 17 in-between the door 11 and the jamb 13. In all modes of the device 10 herein, using means to position the device in the engaged position between the edge 15 of a door 11 and jamb 13, the device 10 prevents the edge 15 of the door 11 from being rotated too close to the surface of the jamb 13, to cause injury to fingers or other body parts which might be positioned in the space 17.

The compressible nature of the material forming the body 12 provides the various modes of the device 10 with a first means to help prevent damage to the door 11 and jamb 13 and hinge 21 members, when the door 11 is rotated toward its closed position within the jamb 13. The device 10 is depicted in the engaged position in FIGS. 1, 8 and 9 ready to prevent injury and sound an alarm on attempted closure.

The body 12 of the device 10 is preferably configured with a plurality of ribs 14 having gaps 16 therebetween as depicted in FIGS. 1-2-3-4 and 7-8-9. In addition to conserving the amount of compressible material needed to form the body 12 itself, the ribs 14 are also deformable into the gaps 16 when the device 10 is in the engaged position and the door 11 is rotated toward a closed position with its edge 15 adjacent to the jamb 13.

Figure 8:
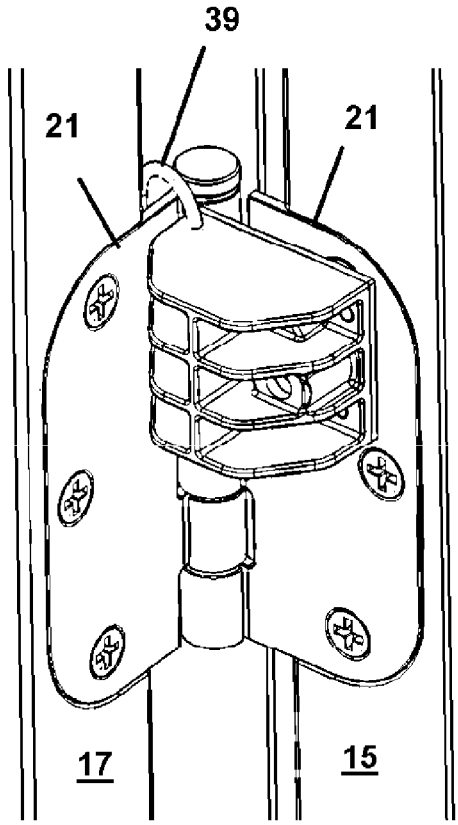
FIG. 8 depicts the device as in FIG. 7 in an engaged position held between the door and the door jamb by a hinge clip rotatably engaged with the device.

The deflection of the ribs 14 into the gaps 16 in combination with the compressible nature of the material forming the body 12, thereby provide an enhanced means to prevent damage to the door 11, hinge 21, and jamb 13 when the door 11 is swung closed with the device 10 in the engaged position of FIGS. 1 and 8. Those skilled in the art will realize the number of ribs 14 and resulting gaps 16 may vary and such is anticipated.

Figure 2:
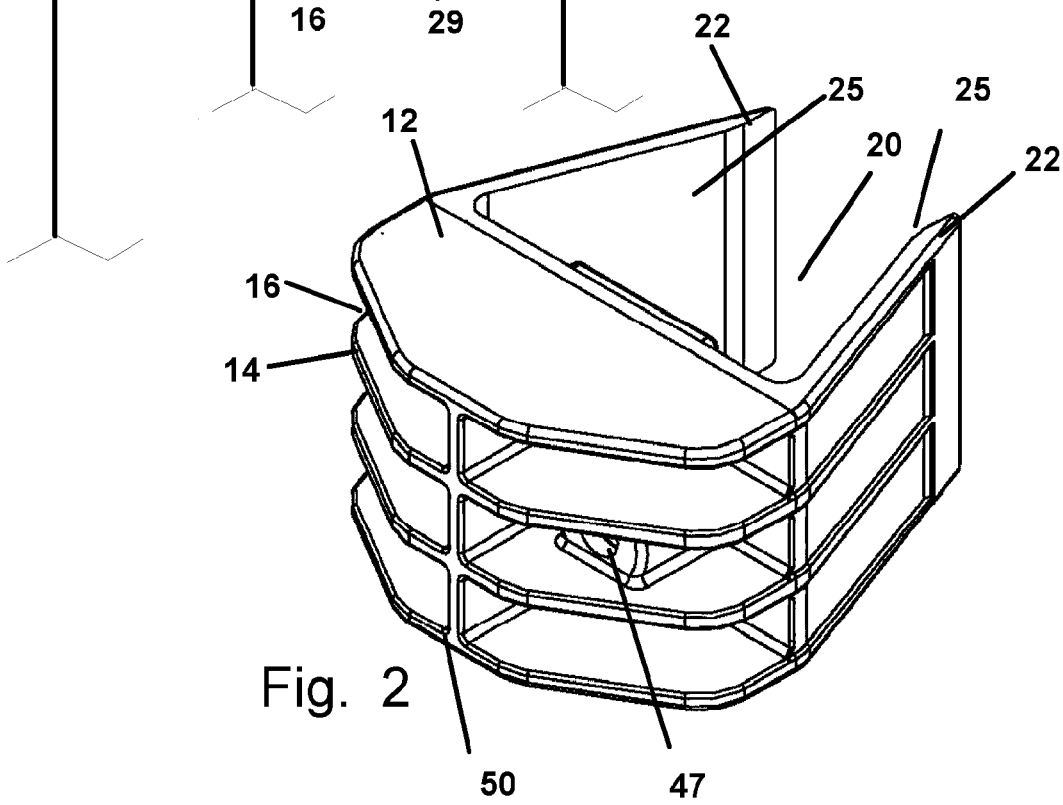
FIG. 2 depicts the device detached from the door and showing ribbed exterior on the body portion with gaps between the projecting ribs.

Also depicted in FIG. 2, is a slot 20 formed between two projecting arms 22 of the device 10 as a means to maintain the device in the engaged position between the door 11 and jamb 13. This slot 20 is adapted in dimension to frictionally engage the door 11 and hold the device 10 in operative frictional engagement along the door edge 15. The slot 20 in mode of the device 10 as shown in FIG. 2, employs angled opposing interior side edges 25 such that the slot 20 narrows at its distal end opposite the body 12. The angled side edges 25 may be accomplished by molding the body 12 in this fashion, or forming the body 12 with inwardly deflecting arms 22 as shown in FIG. 2. The inwardly deflecting arms 22 are particularly preferred as the biasing force is enhanced by the elastic material forming the body 12 when the arms are deflected outward as in FIG. 1 when the device 10 is engaged on the door 11.

These inwardly angled edges 25 combined with the elastic nature of the material forming the body 12, provide a means to bias the arms 22 against the engaged door 11 and thereby provide the biased frictional engagement of the device 10 onto the door 11. This is particularly preferred in that it allows for an operative engagement of the device 10 to the door 11 without adhesive or screws or other fastening measures which will harm the door surface. Avoiding harm to the door surfaces will encourage employment of the device 10 since the natural aversion of homeowners to marring or damaging the door surface is abated.

Also shown in the various figures are the two angled surfaces of the opposing corners 29 of the body 12. The angled surfaces of the corners 29 relative to the edge 15 of the door and the edge of the jamb 13, and a central portion 19 that is parallel to the door edge 15, provide means to prevent marring of the jamb 13 as well as a better compressed engagement of the body 12 in the space 17 between the jamb 13 and the door 11 when an attempt is made to close the door 11.

The device 10 in one mode employs an alarm. As shown in the exploded view of the device 10 of FIG. 3, a means for audible alarm is provided as an additional safety measure. The audible alarm provided in an especially favored mode of the device 10 is recessed within the body 12 and positioned below a bottom edge 30 of the slot 20. An aperture 47 may be provided to aid in sound transmittal.

So positioned, the alarm is activated by compression of the body 12 within the space 17 between the door edge 15 and jamb 13 rather than by depression of a button or other switch component against either the edge 15 or the jamb 13 which would eventually cause damage to those surfaces and most probably to the button or other trigger riding on those surfaces.

Figure 5:
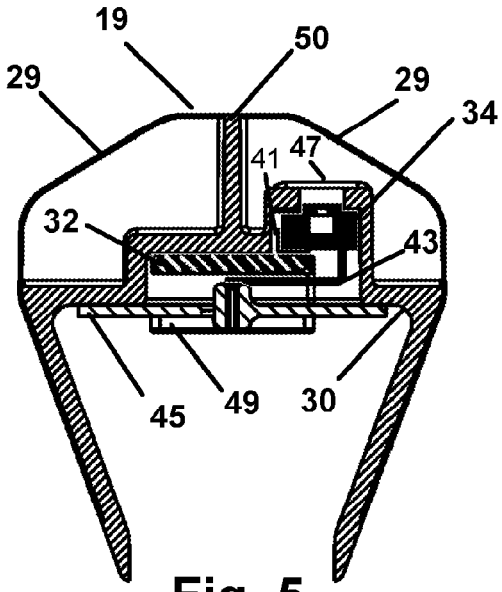
FIG. 5 is a slice through line 5-5 of FIG. 4 showing the components of FIG. 3 operatively positioned within the body.
Figure 4:
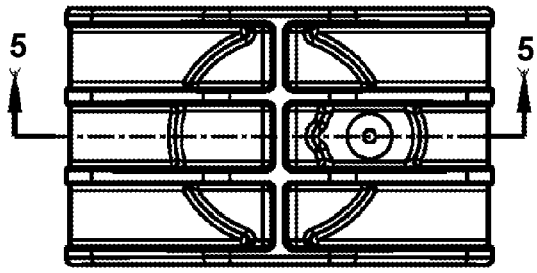
FIG. 4 is an end view of the ribbed body showing the aperture communicating with the alarm.
Figure 6:
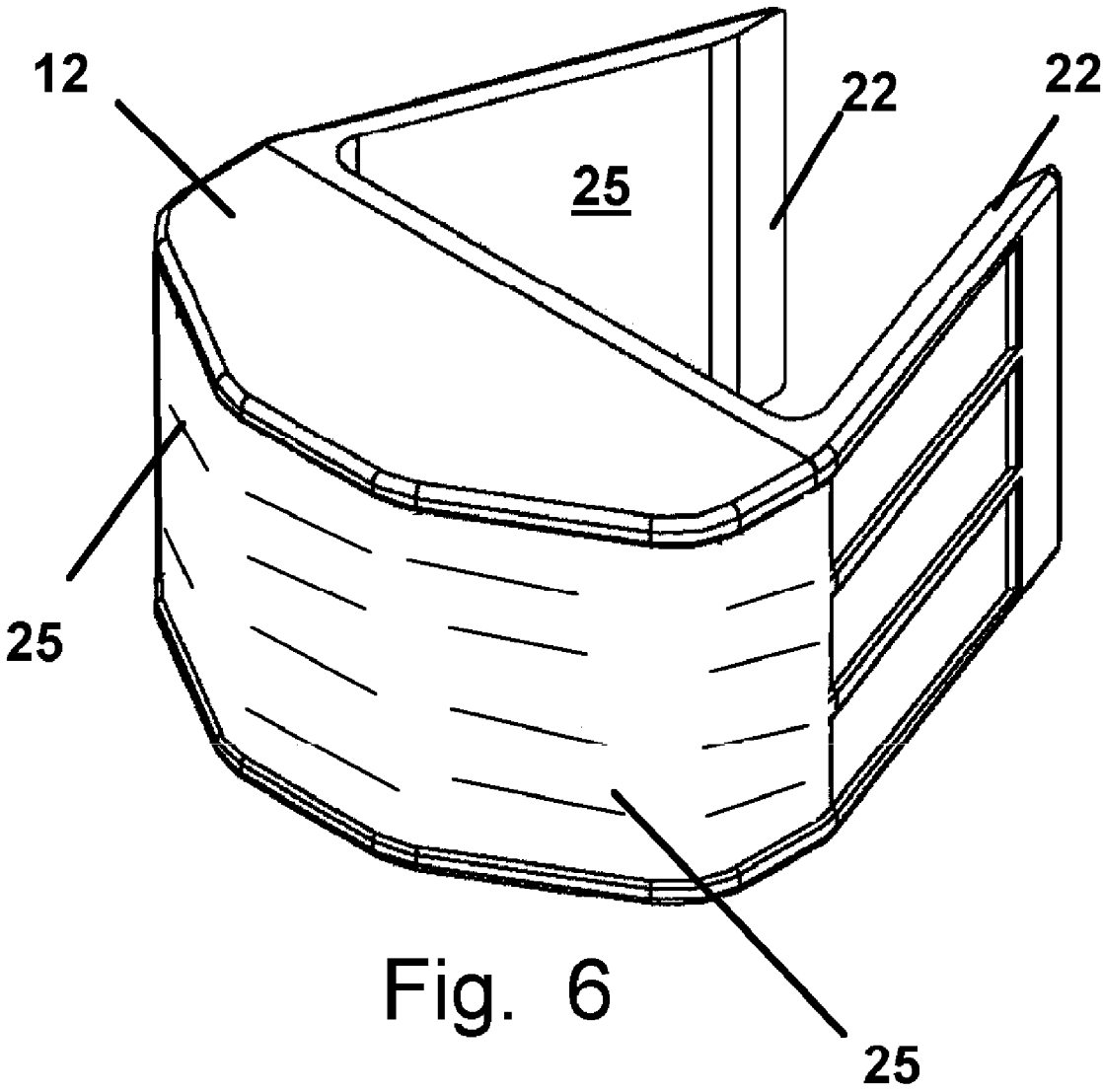
FIG. 6 depicts another mode of the device wherein the body employs compressible material but no ribs.

To achieve this protection of the various surfaces which will also encourage use, the audible alarm means employs a unique means for switching an electrical circuit communicating energy from the battery 32 to an audible alarm such as a buzzer 34 which employs no solder joints or wires which might eventually break in the environment of use of the device 10 over time. As shown in FIG. 5 the battery 32 has a casing in which the positive and negative connections are exposed on two opposing surfaces. A first pole 35 of the battery 32 is formed on one surface and the second pole 37 is on the opposing surface of the battery 32.

Engaged within the body 12 the battery 32 is positioned in between a first wire 41 and second wire 43 which are in electrical communication with the buzzer 34 to provide electrical power from the battery 32 to operate it. In this engaged position in the cavity 27 of the body 12, the battery 32 has the first pole 35 in constant electrical communication with the first wire 41 leading to the buzzer 34. The second wire 34 is positioned out of contact with, but adjacent to, the second pole 37 of the battery 32. The second wire 43 is also positioned below the bottom edge 30 of the slot 20, and can be simply covered by material forming the body 12 in a non serviceable mode of the device 10. While the buzzer 34 and related components might be permanently engaged within the body 12, in a preferred mode of the device 10 where the battery 32 may be easily changed, a removable and deformable switchplate 45 may be engaged at the bottom edge 30 and provide access to the battery 32.

Actuation of the device 10 to energize the buzzer 34 or other audible alarm, is provided by a means for switching and communicating electrical power to the buzzer which is activated by a compression of the body 12 in the space 17 between the door 11 and the jamb 13. This compression creates a deformation of the bottom 30 of the slot 20, which forces the second wire 43 to a contact with the second pole 37 of the battery 32 and thereby completing the circuit to energize the alarm for the duration of the compression. Once compression of the body 12 ceases to be sufficient to deflect the bottom 30 to in turn deflect the second wire 43, to contact the battery 32, the switch will again be open and the alarm noise ceases. Thus, a non marring body-compression means for electrically switching the alarm to an energized mode is provided which operates using the compression of the body 12 to close the circuit, rather than a translating button or other contact type switch which would mar the surface of the door edge 15 or the jamb 13 over time.

Figure 3:
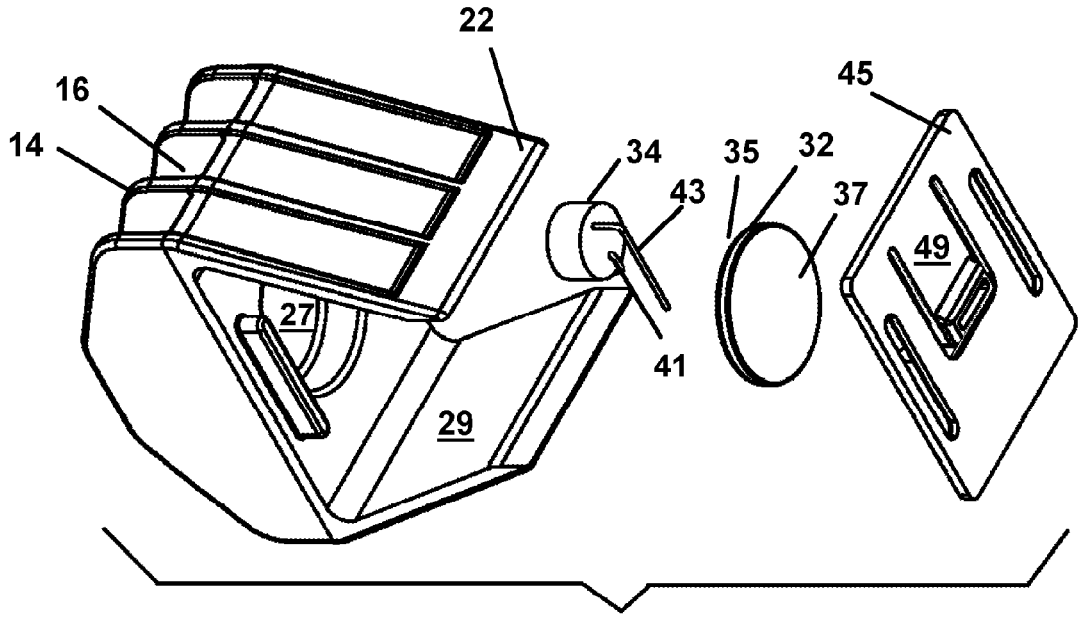
FIG. 3 depicts an exploded view of the device showing the alarm, battery, and switch plate components of the body.
Figure 7:
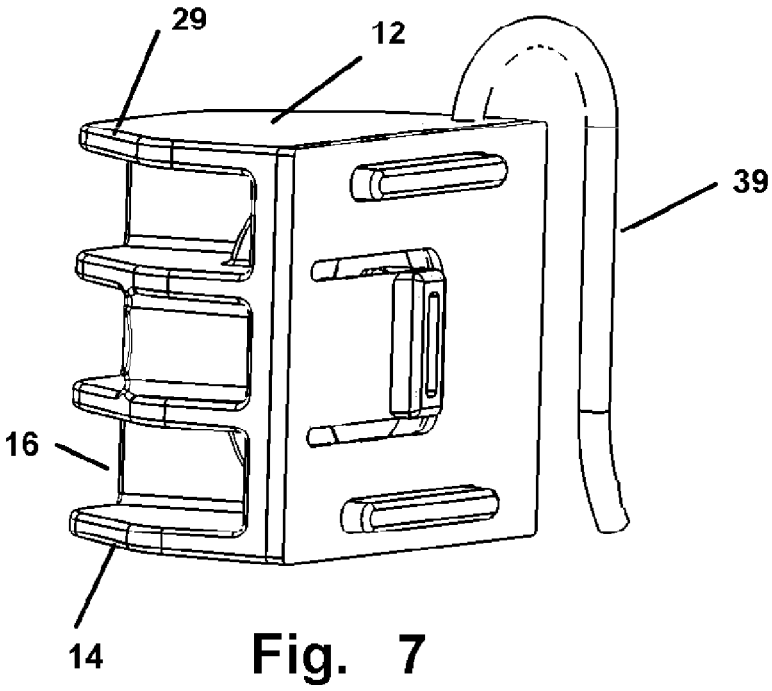
FIG. 7 depicts another preferred mode of the device featuring means of positioning between the door and door jamb which engages with the hinge.

The switchplate 45 includes a deformable flap 49 positioned to contact the second wire 43. As shown in FIGS. 3, 5 and 7, the flap 49 only contacts the second wire 43 with force sufficient to push it against the second pole 37 of the battery 32, when the body 12 is compressed in the space 17 between the edge 15 of the door 11 and the jamb 13 with sufficient force to bend the flap 49. Once body compression falls below a point where the compression ceases to hold the second wire 43 in contact with the battery 32, the circuit opens and the audible alarm ceases.

In the mode of the body 12 having ribs 14, the compressive force is enhanced by a central rib 50 communicating with a bottom wall 52 of the cavity 27. The central rib 50 provides a centered communication of compression force, through the body 12 to push the body 12 and the battery 32 toward the second wire 43 which is equally forced toward the second pole 37 by either the switchplate 45, if employed, or the contact edge 30 surface of the body. This central rib 50 thus enhances the performance of the compression means for switching the audible alarm to the energized state where it emits noise.

Of course other means for completing the circuit to activate the buzzer 34 or other alarm might be employed as would occur to those in the art, however the simplicity and reliability of the depicted solderless compression means for closing the switch is preferred for the aforementioned reasons.

In a particularly preferred mode of the device 10 shown in FIGS. 7-8, a clip 39 provides means to hold the body 12 positioned in an engaged position between the door 11 and jamb 13. The clip 39 as depicted is formed in a manner to engage over the top of the hinge 21 member and thereby hold the device 10 in-between the two hinge 21 members ready for use in the above noted fashion to prevent over closure past a point where injury can occur and/or to sound an alarm. This mode of the device 10 employs the clip 39 in place of the arms 22 as a means to maintain the device 10 in the space 17. Of course those skilled in the art will realize that other means to position the device 10 in an engaged position in the space 17 between a door 11 and door jamb 13 may be employed, such as adhesive, or hook and loop fabric, or screws. Consequently any such means for positioning the device 10 in the engaged position in the space or gap 17 between an open door 11 and door jamb 13 as would occur to those skilled in the art is anticipated within the scope of this patent.

The clip 39 is rotatably engaged to the body 12 such that the body 12 rotates on the clip 39 which is engaged to the hinge 21 member thereby allowing the body 12 to rotate with the door 11 as needed. In all other aspects the device 10 performs as noted above.

Figure 9:
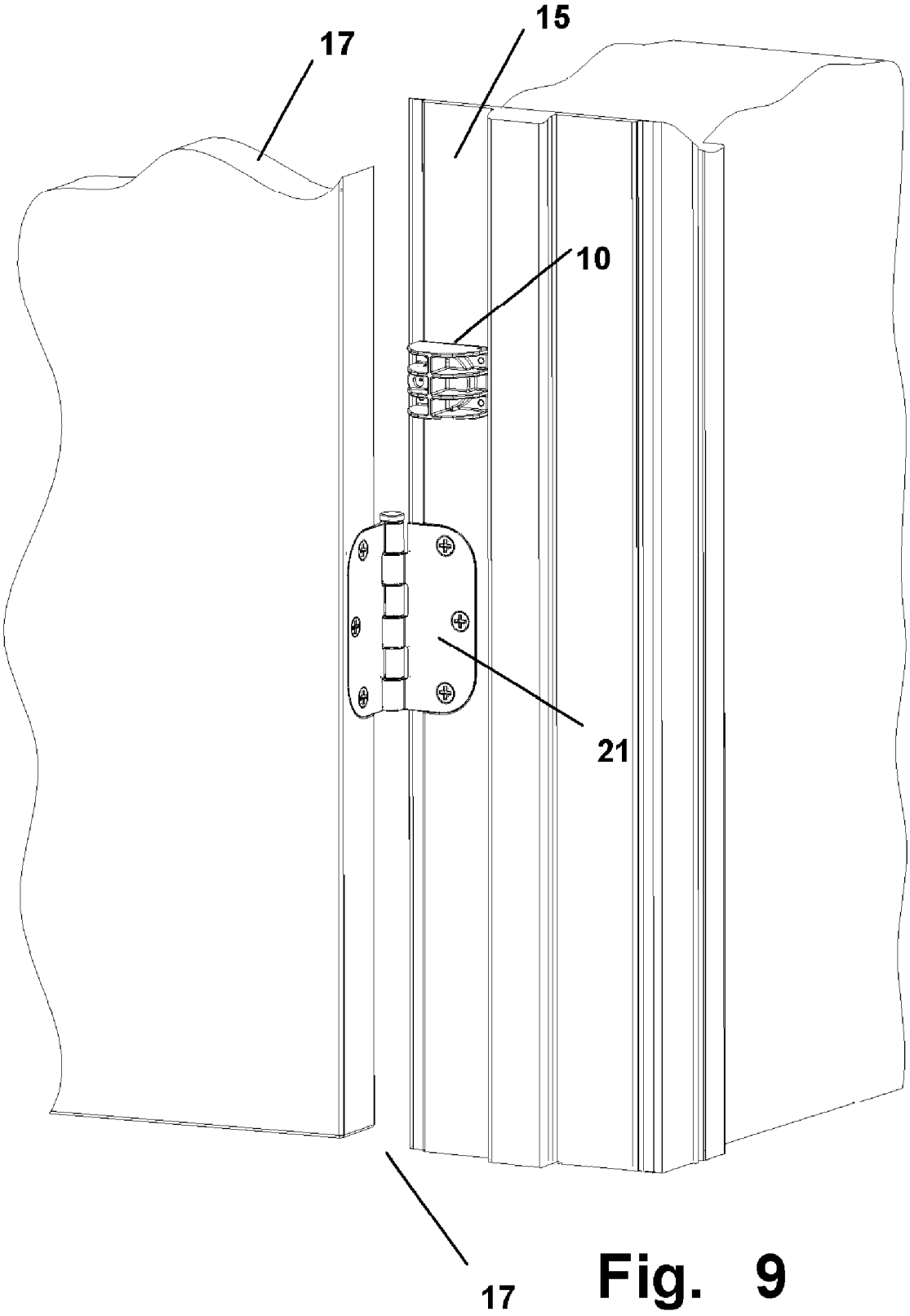
FIG. 9 shows still another preferred mode of the device featuring means of positioning between the door and door jamb which attaches to the jamb or door edge.

As depicted in FIGS. 7-8, this mode of the device 10 is particularly preferred in that it provides additional means to prevent marring to the door 11 or jamb 13 during closure of the door 11 upon the device 10 during use by positioning it between the members forming the hinge 21. Of course other means for positioning the device 10 in the operative position such as shown in FIG. 9 may be employed to hold the device 10 in the operative position in the gap 17 or between the members forming the hinge 21. The device 10 as depicted in FIG. 9, engaged upon the jamb 13 may employ means for positioning such as adhesive, hook and loop fabric, or fasteners such as screws which as noted above are well known and need not be shown. However, the clip 39 provides a means of attachment which will encourage use because it is more easily engaged and removed than fasteners or adhesives.

While all of the fundamental characteristics and features of the invention have been shown and described herein, with reference to particular embodiments thereof, a latitude of modification, various changes and substitutions are intended in the foregoing disclosure and it will be apparent that in some instances, some features of the invention may be employed without a corresponding use of other features without departing from the scope of the invention as set forth. It should also be understood that various substitutions, modifications, and variations may be made by those skilled in the art without departing from the spirit or scope of the invention. Consequently, all such modifications and variations and substitutions are included within the scope of the invention as defined by the following claims.

What is claimed is:

1. An alarm equipped door safety device for a door rotationally engaged by hinges to a door jamb, comprising:

a body formed of elastic material;

means for maintaining said body in an operative position in a space between a vertical edge of said door engaged to a hinge, and said door jamb;

said body contacting said door edge and said door jamb during movement of said door in a closing direction wherein said body provides means for maintaining said edge of said door a distance away from said door jamb;

said distance providing means to prevent a crushing of a finger or other object which is narrower than said distance and which is inserted in-between said door edge and said door jamb during movement of said door in said closing direction in an attempted closure of said door into said door jamb;

a door closure alarm as a component of said door safety device;

means for activation of said alarm to sound an audible warning; and said means for activation employing movement of the said door in a closing direction.

2. The door safety device of claim 1 wherein said means for maintaining said body in an operative position comprises a clip rotationally engaged with said body, said clip shaped to hang upon a hinge.

3. The door safety device of claim 2 additionally comprising:

a plurality of ribs surrounding gaps formed on said body;

said ribs deformable during said attempted closure of said door; and said ribs deforming into said gaps providing means to absorb a force imparted to said door by a user during said attempted closure, to thereby prevent damage to one or a combination of said door, said door jamb, and said hinges.

4. The door safety device of claim 3 additionally comprising:

said alarm component housed within said body;

said alarm component having a sound emitter;

said alarm component having a battery; and body compression activated switching means for providing a communication of electrical power from said battery, to said sound emitter;

whereby, a compression of said body causes said switching means to operatively close a circuit between said battery and said sound emitter to provide said power thereto, only when said body is in said operative position and compressed between said door jamb and said door during said closure of said door.

5. The door safety device of claim 4 wherein said body compression activated switching means comprises:

said circuit having a first wire engaged between a first pole of said battery and a first pole of said sound emitter;

said circuit having a second wire engaged with a second pole of said sound emitter and adjacent to, but disengaged from, a second pole of said battery; and said second wire contacting said second pole of said battery only when said body is compressed between said door and said door jamb.

6. The door safety device of claim 5 additionally comprising:

said body including a removable plate;

removal of said plate providing means to access said battery;

a flap formed in said plate, said flap positioned adjacent to said second wire; and said flap deflectable toward said battery to generate a contact of said second wire with said battery.

7. The door safety device of claim 2 additionally comprising:

a plurality of ribs surrounding gaps formed on said body;

said ribs deformable during said attempted closure of said door; and said ribs deforming providing means to absorb a force imparted to said door by a user during said attempted closure, to thereby prevent damage to one or a combination of said door, said door jamb, and said hinges.

8. The door safety device of claim 7 additionally comprising:

said alarm component housed within said body;

said alarm component having a sound emitter;

said alarm component having a battery; and body compression activated switching means for providing a communication of electrical power from said battery, to said sound emitter;

whereby, a compression of said body causes said switching means to operatively close a circuit between said battery and said sound emitter to provide said power thereto, only when said body is in said operative position and compressed between said door jamb and said door during said closure of said door.

9. The door safety device of claim 8 wherein said body compression activated switching means comprises:

said circuit having a first wire engaged between a first pole of said battery and a first pole of said sound emitter;

said circuit having a second wire engaged with a second pole of said sound emitter and adjacent to, but disengaged from, a second pole of said battery; and said second wire contacting said second pole of said battery only when said body is compressed between said door and said door jamb.

10. The door safety device of claim 1 wherein said means for maintaining said body in an operative position comprises one or a combination of positioners from a group including adhesive, hook and loop fabric, and fasteners adapted to engage said door or said jamb.

11. The door safety device of claim 10 additionally comprising:

said alarm component housed within said body;

said alarm component having a sound emitter;

said alarm component having a battery; and body compression activated switching means for providing a communication of electrical power from said battery, to said sound emitter;

whereby, a compression of said body causes said switching means to operatively close a circuit between said battery and said sound emitter to provide said power thereto, only when said body is in said operative position and compressed between said door jamb and said door during said closure of said door.

12. The door safety device of claim 11 wherein said body compression activated switching means comprises:

said circuit having a first wire engaged between a first pole of said battery and a first pole of said sound emitter;

said circuit having a second wire engaged with a second pole of said sound emitter and adjacent to, but disengaged from, a second pole of said battery; and said second wire contacting said second pole of said battery only when said body is compressed between said door and said door jamb.

13. The door safety device of claim 12 additionally comprising:

said body including a removable plate;

removal of said plate providing means to access said battery;

a flap formed in said plate, said flap positioned adjacent to said second wire; and said flap deflectable toward said battery to generate a contact of said second wire with said battery.

14. The door safety device of claim 1 additionally comprising:

a plurality of ribs surrounding gaps formed in said body;

said ribs deformable during said attempted closure of said door; and said ribs deforming during said attempted closure providing means to absorb force to prevent damage to one or a combination of said door, said door jamb, and said hinges, during said attempted closure of said door with said safety device in said operative position.

15. The door safety device of claim 14 additionally comprising:

said alarm component housed within said body;

said alarm component having a sound emitter;

said alarm component having a battery; and body compression activated switching means for providing a communication of electrical power from said battery, to said sound emitter;

whereby, a compression of said body causes said switching means to operatively close a circuit between said battery and said sound emitter to provide said power thereto, only when said body is in said operative position and compressed between said door jamb and said door during said closure of said door.

16. The door safety device of claim 15 wherein said body compression activated switching means comprises:

said circuit having a first wire engaged between a first pole of said battery and a first pole of said sound emitter;

said circuit having a second wire engaged with a second pole of said sound emitter and adjacent to, but disengaged from, a second pole of said battery; and said second wire contacting said second pole of said battery only when said body is compressed between said door and said door jamb.

17. The door safety device of claim 16 additionally comprising:

said body including a removable plate;

removal of said plate providing means to access said battery;

a flap formed in said plate, said flap positioned adjacent to said second wire; and said flap deflectable toward said battery to generate a contact of said second wire with said battery.

18. The door safety device of claim 1 additionally comprising:

said alarm component housed within said body;

said alarm component having a sound emitter;

said alarm component having a battery; and body compression activated switching means for providing a communication of electrical power from said battery, to said sound emitter;

said switching means closing a circuit between said battery and said sound emitter to provide said power thereto, only when said body is in said operative position and compressed between said door jamb and said door during said attempted closure of said door.

19. The door safety device of claim 18 wherein said body compression activated switching means comprises:

said circuit having a first wire engaged between a first pole of said battery and a first pole of said sound emitter;

said circuit having a second wire engaged with a second pole of said sound emitter and adjacent to, but disengaged from, a second pole of said battery; and said second wire contacting said second pole of said battery only when said body is compressed between said door and said door jamb.

20. The door safety device of claim 1 additionally comprising:

said body including a removable plate;

removal of said plate providing means to access said battery;

a flap formed in said plate, said flap positioned adjacent to said second wire; and said flap deflectable toward said battery to generate a contact of said second wire with said battery.

* * * * *